US005711745A

United States Patent [19]

Yang

[11] Patent Number: 5,711,745

[45] Date of Patent: Jan. 27, 1998

[54] MULTI-PURPOSE EXERCISE MACHINE

[76] Inventor: Li-Hsiang Yang, 11, Alley 1, Lane 78, Chang Lu Road, Changhua, Taiwan

[21] Appl. No.: 754,316

[22] Filed: Nov. 21, 1996

[51] Int. Cl.[6] ..... A63B 22/02

[52] U.S. Cl. ..... 482/54; 422/51

[58] Field of Search ..... 422/54, 51

[56] References Cited

U.S. PATENT DOCUMENTS

| | | | |
|---|---|---|---|
| 931,394 | 8/1909 | Day | 482/54 |
| 4,350,336 | 9/1982 | Hanford | 482/54 |
| 5,662,557 | 9/1997 | Watterson et al. | 482/54 |

*Primary Examiner*—Lynne A. Reichard

*Attorney, Agent, or Firm*—Beveridge, DeGrandi, Weilacher & Young LLP

[57] ABSTRACT

A multi-purpose exercise machine is composed of a grip frame and a treading frame. The grip frame is of a U-shaped construction and is fastened at both ends thereof with the treading frame which can be folded to join with the grip frame so as to reduce the volume of the exercise machine for easy storage and shipping. The treading frame is provided with a plurality of rolling cylinders capable of affording an exerciser ther massaging exercise, the jogging exercise, and the walking exercise.

4 Claims, 5 Drawing Sheets

MULTI-PURPOSE EXERCISE MACHINE

FIELD OF THE INVENTION

The present invention relates generally to an exercise machine, and more particularly to a multi-purpose exercise machine intended for use in doing a massage, a jogging exercise, or a walking exercise.

BACKGROUND OF THE INVENTION

The conventional exercise machines are generally designed for doing a specific kind of exercise. As a result, the consumers must buy a variety of exercise machines for doing different kinds of exercise. These exercise machines are expensive and take up two much of the floor space. Most consumers live in a house or apartment with a limited spare space, which is grossly inadequate for keeping various exercise machines.

SUMMARY OF THE INVENTION

It is therefore the primary objective of the present invention to provide a multi-purpose exercise machine which can be used interchangeably as a massaging device, a walking machine, or a jogging machine.

It is another objective of the present invention to provide a multi-purpose exercise machine which can be folded for an easy storage or shipping.

In keeping with the principle of the present invention, the foregoing objectives of the present invention are attained by a multi-purpose exercise machine, which is composed of grip frame and a treading frame. The grip frame is of a U-shaped construction and is fastened at both open ends thereof with the front end of the treading frame. The treading frame can be folded to join with the grip frame so as to reduce the volume of the exercise machine for an easy storage or shipping.

The foregoing objectives, features, functions and advantages can be more readily understood upon a thoughtful deliberation of the following detailed description of the embodiment of the present invention in conjunction with the accompanying drawings.

DETAILED DESCRIPTION OF THE EMBODIMENT

Figure 1:
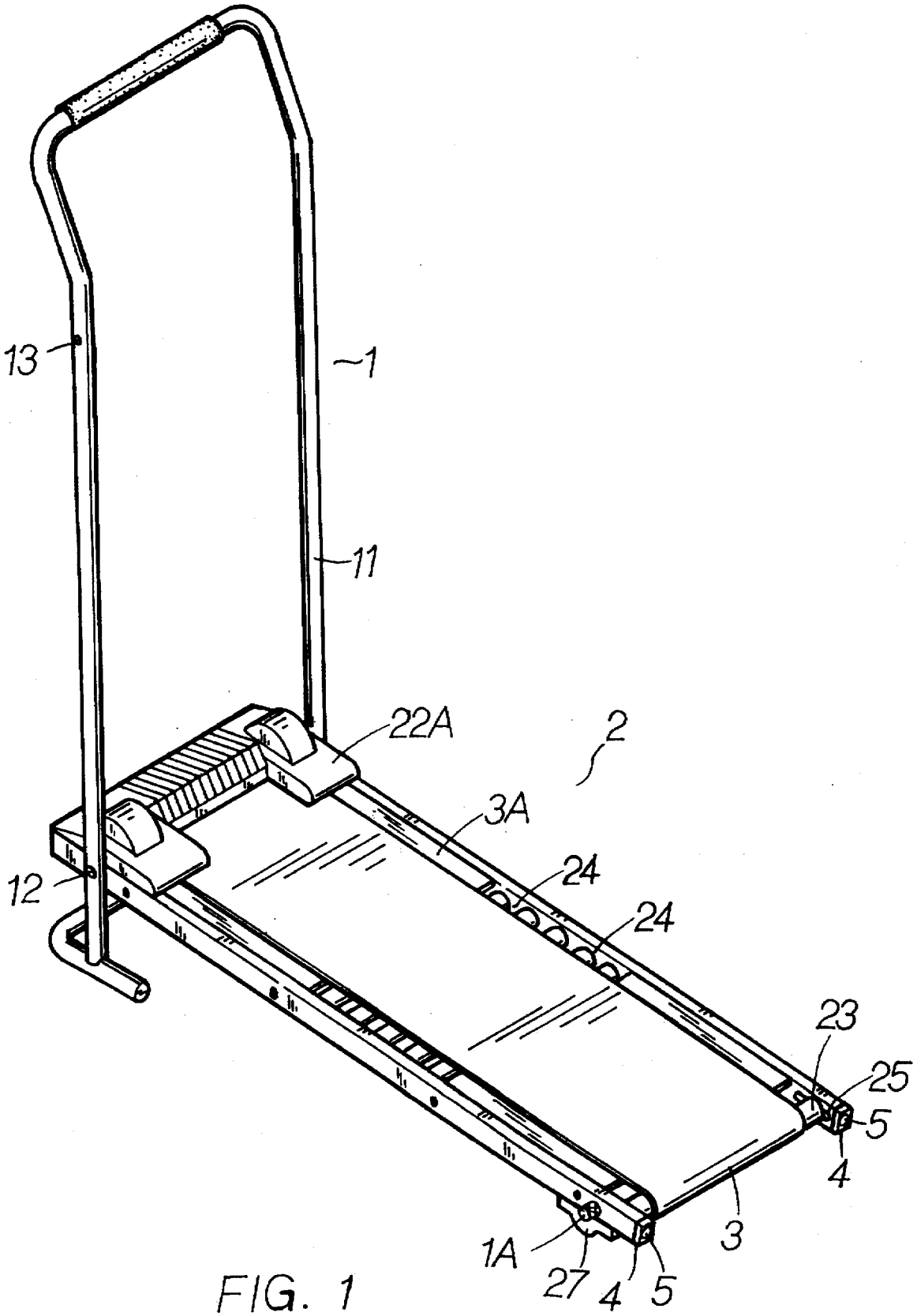
FIG. 1 shows a perspective view of a multi-purpose exercise machine of the present invention.
Figure 2:
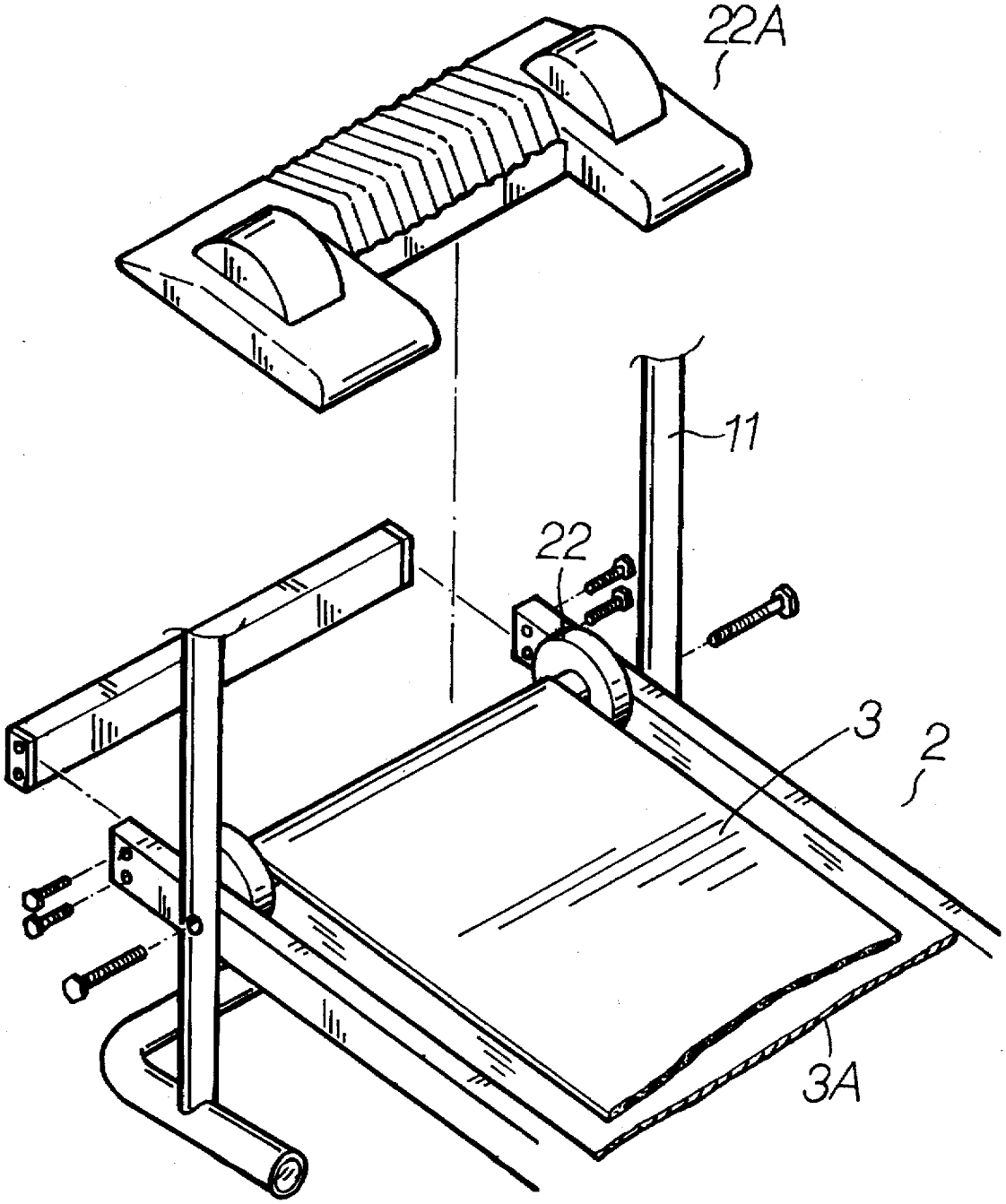
FIG. 2 shows a partial exploded view of the multi-purpose exercise machine of the present invention.
Figure 3:
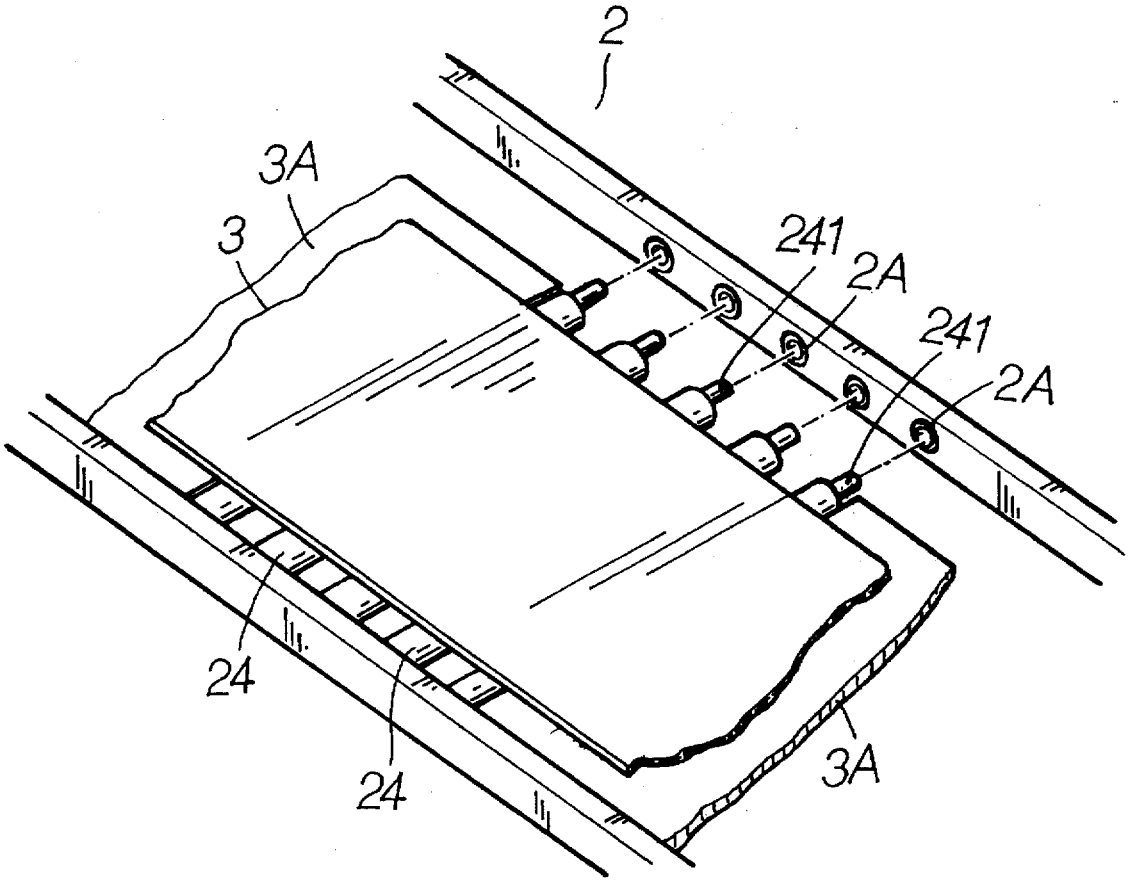
FIG. 3 shows another partial exploded view of the multi-purpose exercise machine of the present invention.
Figure 4:
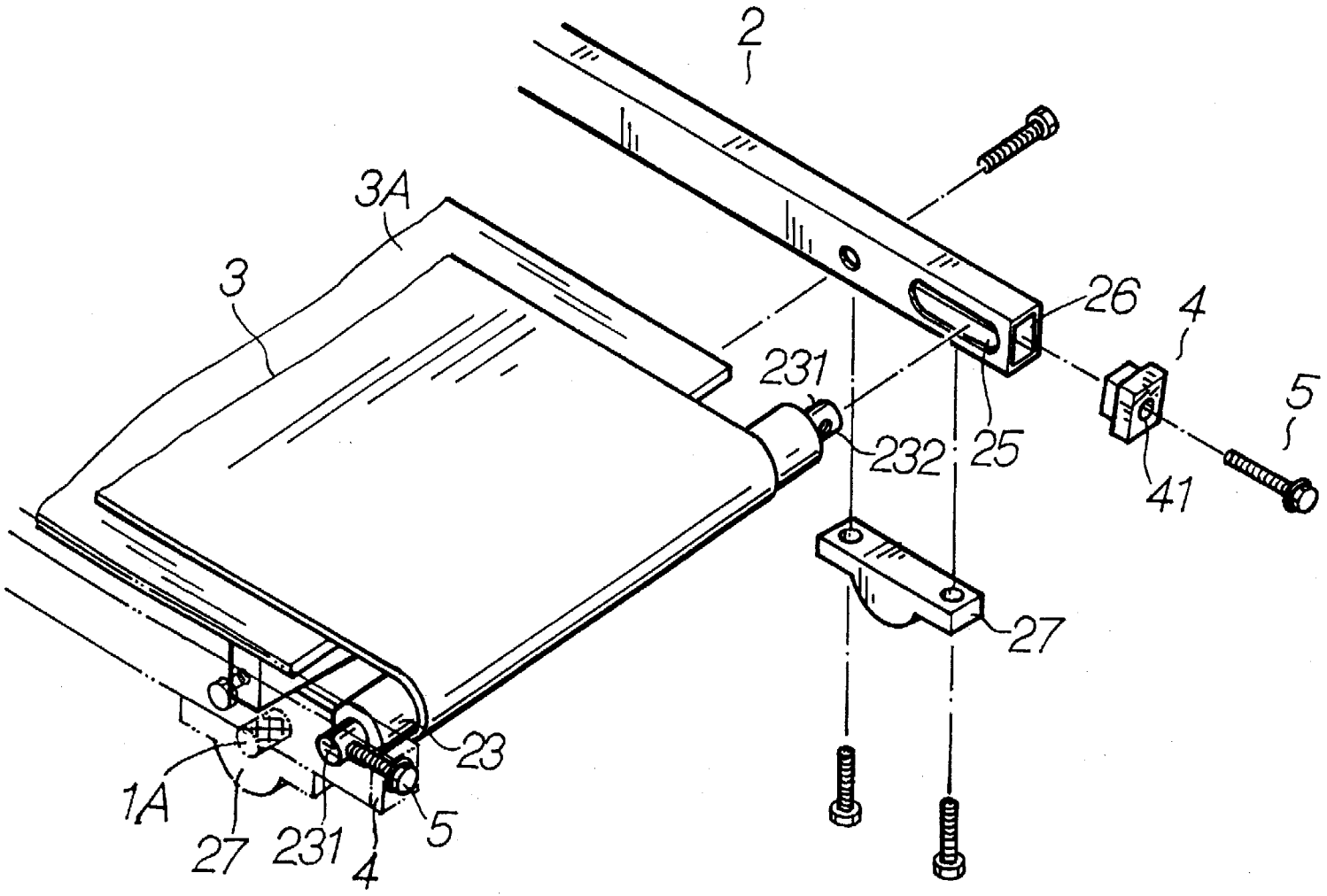
FIG. 4 shows still another partial exploded view of the multi-purpose exercise machine of the present invention.

As shown in FIGS. 1–4, a multi-purpose exercise machine embodied in the present invention is composed of a grip frame 1 and a treading frame 2. The grip frame 1 is of a U-shaped construction and is composed of two arms 11. The arms 11 are provided respectively at the open end thereof with a fastening hole 12 in which a screw (not shown in the drawings) is received for fastening the grip frame I with the front end of the treading frame 2. One of the two arms 11 is provided at the upper segment thereof with a through hole 13. One side of the treading frame 2 is provided with a through hole 21 corresponding in location to the through hole 13 of the grip frame 1 and engageable with a locating pin 1A. The treading frame 2 comprises a front cross rod 22 and a rear cross rod 23. The front cross rod 22 is provided respectively at both ends thereof with a cover 22A. Located between the front cross rod 22 and the rear cross rod 23 are a plurality of rolling cylinders 24, as illustrated in FIG. 3. The rolling cylinders 24 are provided respectively at both ends thereof with a fastening portion 241 which is rotatably engaged with the fastening hole 2A of the treading frame 2. The rolling cylinders 24 are provided thereon with a support board 3A and a foot pad 3.

The rear cross rod 23 is provided respectively at both ends thereof with a fastening portion 231 having a threaded hole 232. The fastening portion 231 is rotatably engaged with an oblong hole 25. The treading frame 2 is provided at the rear end thereof with a hollow portion 26 which is engaged with a locating block 4 having a screw hole 41. A fastening screw 5 is received in the screw hole 41 such that the fastening screw 5 is engaged with the threaded hole 232 of the fastening portion. 231 of the rear cross rod 23. The treading frame 2 is provided respectively in the undersides of both rear ends thereof with a locating pad 27.

In operation, the fastening portions 231 of the rear cross rod 23 are caused to move back and forth in the oblong holes 25 of the treading frame 2 such that the foot pad 3 is fastened and unfastened in rotation for providing an exerciser with a massaging exercise, a jogging exercise, or a walking exercise.

Figure 5:
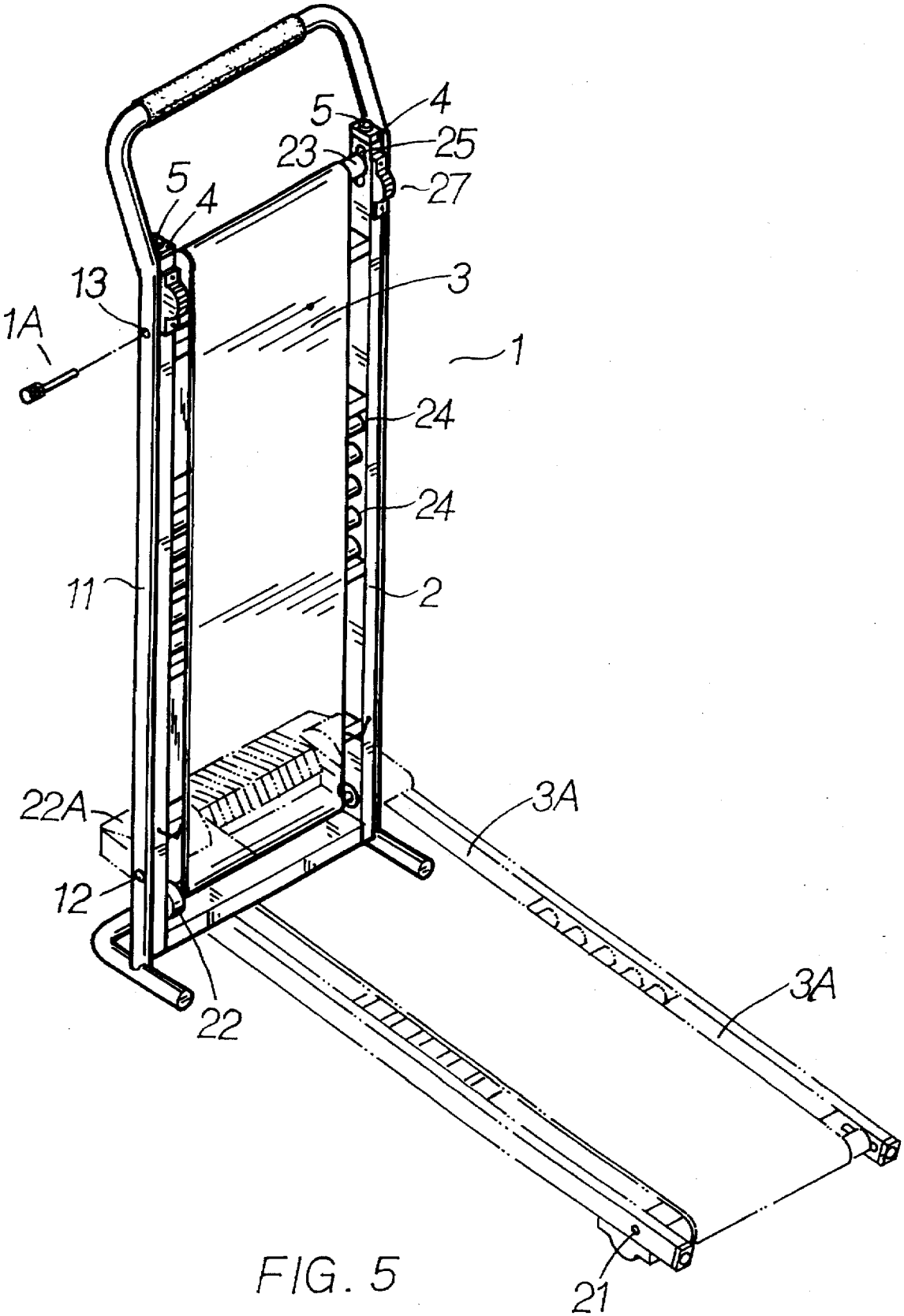
FIG. 5 is a schematic view illustration the way that the exercise machine of the present invention is folded for storage.

As shown in FIG. 5, the exercise machine of the present invention can be folded such that the treading frame 2 is folded to join with the grip frame 1, and that the treading frame 2 and the grip frame 1 are held together by a locating pin 1A which is received in the through hole 13 of the grip frame 1 and the through hole 21 of the treading frame 2.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claim.

What is claimed is:

1. A multi-purpose exercise machine comprising a grip frame of a U-shaped construction and a treading frame, said grip frame composed of two arms provided respectively at an open end thereof with a fastening hole for receiving therein a screw for fastening said grip frame with said treading frame, one of said two arms provided at an upper segment thereof with a through hole, said treading frame provided with a through hole corresponding in location to said through hole of said grip frame and engageable with a locating pin, said treading frame comprising a front cross rod and a rear cross rod, with said front cross rod being provided respectively at both ends thereof with a cover, said front cross rod and said rear cross rod provided therebetween a plurality of rolling cylinders which are provided respectively at both ends thereof with a fastening portion engaged rotatably with said fastening hole of said treading frame, said rolling cylinders further provided thereon with a support board and a foot pad, said rear cross rod provided respectively at both ends thereof with a fastening portion having a threaded hole and engaging rotatably an oblong hole, said treading frame provided at a rear end thereof with a hollow portion which is engaged with a locating block having a screw hole for receiving a screw such that said screw is engaged with said threaded hole of said fastening portion of said rear cross rod.

2. The multi-purpose exercise machine as defined in claim 1, wherein said treading frame is provided respectively in the undersides of both rear ends thereof with a locating pad.

3. The multi-purpose exercise machine as defined in claim 1, wherein said fastening portion of said rear cross rod is capable of moving back and forth in said oblong hole of said treading frame.

4. The multi-purpose exercise machine as defined in claim 1, wherein said treading frame can be folded to join with said grip frame such that said treading frame and said grip frame are held together by said locating pin which is received in said through hole of said grip frame and said through hole of said treading frame.

* * * * *